US010415811B2

(12) United States Patent
Sun et al.

(10) Patent No.: US 10,415,811 B2
(45) Date of Patent: Sep. 17, 2019

(54) COMPACT LED LIGHT ENGINE

(71) Applicant: ShineOn Holding Incorporation, Grand Cayman (KY)

(72) Inventors: Guoxi Sun, Winchester, MA (US); Jay Liu, Andover, MA (US)

(73) Assignee: SHINEON HOLDING INCORPORATION, Grand Cayman (KY)

( * ) Notice: Subject to any disclaimer, the term of this patent is extended or adjusted under 35 U.S.C. 154(b) by 0 days.

(21) Appl. No.: 16/052,368

(22) Filed: Aug. 1, 2018

(65) Prior Publication Data

US 2019/0041046 A1 Feb. 7, 2019

Related U.S. Application Data

(60) Provisional application No. 62/540,227, filed on Aug. 2, 2017.

(51) Int. Cl.

| | |
|---|---|
| ***F21K 9/64*** | (2016.01) |
| ***F21K 9/68*** | (2016.01) |
| ***F21V 23/00*** | (2015.01) |
| ***F21V 23/06*** | (2006.01) |
| ***H05B 33/08*** | (2006.01) |
| ***F21V 29/503*** | (2015.01) |

(52) U.S. Cl.

CPC ..... *F21V 23/005* (2013.01); *F21K 9/64* (2016.08); *F21K 9/68* (2016.08); *F21V 23/002* (2013.01); *F21V 23/06* (2013.01); *F21V 29/503* (2015.01); *H05B 33/086* (2013.01); *H05B 33/0824* (2013.01)

(58) Field of Classification Search

CPC ..... F21V 23/005; F21V 23/002; F21V 23/23; F21V 29/503; H05B 33/086; H05B 33/0824; F21K 9/68; F21K 9/64; F21K 9/20; F21K 9/23; F21K 9/27

See application file for complete search history.

(56) References Cited

U.S. PATENT DOCUMENTS

| | | | | |
|---|---|---|---|---|
| 9,784,417 | B1 * | 10/2017 | Springer | F21K 9/238 |
| 9,791,111 | B1 * | 10/2017 | Huang | F21K 9/20 |
| 2014/0029249 | A1 * | 1/2014 | Matsukawa | F21V 23/002 362/218 |
| 2015/0308632 | A1 * | 10/2015 | Ueno | F21S 8/02 362/235 |
| 2017/0067622 | A1 * | 3/2017 | Chao | F21V 19/006 |
| 2017/0343185 | A1 * | 11/2017 | Fieberg | F21V 5/045 |
| 2018/0368233 | A1 * | 12/2018 | Xiong | F21K 9/278 |

* cited by examiner

*Primary Examiner* — Joseph L Williams
*Assistant Examiner* — Jose M Diaz
(74) *Attorney, Agent, or Firm* — Nixon Peabody LLP; Zhou Lu

(57) ABSTRACT

The present disclosure is directed to an LED engine comprising an LED light emitting board, a first circuit board, and a second circuit board. The LED light emitting board and two circuit boards are electrically connected via array cables. Either the first circuit board or the second circuit board has a linear LED driver IC. The first circuit board and the second circuit board, in combination, are configured to receive an AC line voltage, and drive the LED light emitting board. In some implementations, LEDs connected to the LED light emitting board are divided into two or more sections, each of which has a different correlated color temperature (CCT) to achieve CCT tuning. In some implementations, the LED engine further comprises a light engine housing.

16 Claims, 9 Drawing Sheets

COMPACT LED LIGHT ENGINE

CROSS-REFERENCE TO RELATED APPLICATION

This application claims priority to U.S. Provisional Patent Application No. 62/540,227, filed Aug. 2, 2017, titled "A COMPACT LED LIGHT ENGINE WITH LOW FLICKER AND COMPATIBLE TO TRIAC DIMMER," the contents of which are herein incorporated by reference.

TECHNICAL FIELD

The present disclosure relates to a compact LED light engine design.

BACKGROUND

Light emitting diodes (LEDs) offer long-lasting and energy-efficient light sources, and have become more and more popular in illumination devices. Traditional LED light sources use LED driver of AD/DC converter to achieve low percent flicker and be compatible with a triode for alternating current (TRIAC) dimmer.

However, traditional LED drivers require complex circuit blocks to achieve a desired color and intensity tuning at the same time. These traditional LED drivers with complex circuit blocks have large sizes and, thus, cannot easily fit into small lamps and other small illumination devices.

Thus, there is a need for an LED light source having a compact and dimmable design with a low percent flicker, or low modulation index.

BRIEF DESCRIPTION OF THE DRAWINGS

The accompanying drawings exemplify the embodiments of the present disclosure and, together with the description, serve to explain and illustrate principles of the disclosure. The drawings are intended to illustrate major features of the exemplary embodiments in a diagrammatic manner. The drawings are not intended to depict every feature of actual embodiments nor relative dimensions of the depicted elements, and are not drawn to scale.

DETAILED DESCRIPTION

Figure 1:
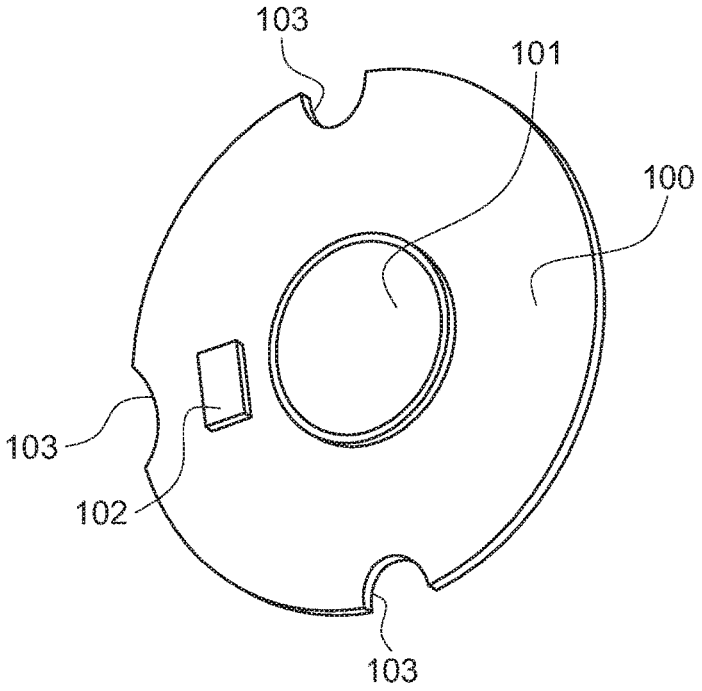
FIG. 1 illustrates an exemplary LED board of an LED light engine, in accordance with an implementation of the present disclosure.

The present disclosure is described with reference to the attached figures, where like reference numerals are used throughout the figures to designate similar or equivalent elements. The figures are not drawn to scale and are provided merely to illustrate the instant disclosure. Several aspects of the disclosure are described below with reference to example applications for illustration. It should be understood that numerous specific details, relationships, and methods are set forth to provide a full understanding of the disclosure. One having ordinary skill in the relevant art, however, will readily recognize that the disclosure can be practiced without one or more of the specific details, or with other methods. In other instances, well-known structures or operations are not shown in detail to avoid obscuring the disclosure. The present disclosure is not limited by the illustrated ordering of acts or events, as some acts may occur in different orders and/or concurrently with other acts or events. Furthermore, not all illustrated acts or events are required to implement a methodology in accordance with the present disclosure.

The present disclosure is directed to an LED engine comprising an LED light emitting board, a first circuit board, and a second circuit board. The LED light emitting board and two circuit boards are electrically connected via array cables. Either the first circuit board or the second circuit board has a linear LED driver IC. The first circuit board and the second circuit board, in combination, are configured to receive an AC line voltage, and drive the LED light emitting board. In some implementations, LEDs connected to the LED light emitting board are divided into two or more sections, each of which has a different correlated color temperature (CCT) to achieve CCT tuning. In some implementations, the LED engine further comprises a light engine housing.

FIG. 1 illustrates an exemplary LED board 100 of an LED light engine, in accordance with an implementation of the present disclosure. In this example, the LED board 100 comprises a light emitting area 101 located in the center and an electrical component 102. LEDs connected to the LED light emitting board are divided into two or more sections corresponding to a linear driver IC, which is further illustrated in FIG. 3. Each of these LED sections could have a different CCT to achieve CCT tuning.

In some implementations, the linear driver IC delivers power to some or all the LED sections according to dimmer settings. For example, the linear driver IC is a two-channel linear driver IC. The LEDs of the LED board 100 comprises two sections, one of which is a low CCT while the other one is a high CCT. When a dimmer setting is below a threshold value, only LEDs corresponding to the low CCT are powered. When the dimmer setting is above the threshold value, LEDs corresponding to the high CCT start to power up such that a perceived CCT is a mix of LEDs corresponding to both low CCT and high CCT. In some implementations, a better CCT tuning may be achieved using a linear driver IC with a higher channel count and LEDs divided into more sections, each of which corresponds to a different CCT.

In some implementations, the LED board 100 is a Chip-on-Board (COB) with the light emitting area 101 located in the center. The LEDs are bonded directly to the board to form a single light-emitting module. In some implementations, the LEDs are flip-chips with wavelength conversion material encapsulated. In this example, the LED flip-chips can sit directly on the LED board 100. The flip-chip design may also be helpful to achieve small sizes, low inductance, and good heat dissipation.

In some implementations, the LEDs of one or more of these LED sections can be a chip-scale-package. The chip-scale-package has a layer of wavelength conversion material placed in front of the encapsulated wavelength conversion material.

In some implementations, the LED board 100 further comprises one or more cut-outs 103. The cutouts 103 are configured to facilitate air circulations around the LED board 100, and/or facilitate assembling of the LED board 100 onto the LED light engine or dissembling the LED board 100 from the LED light engine.

Figure 2:
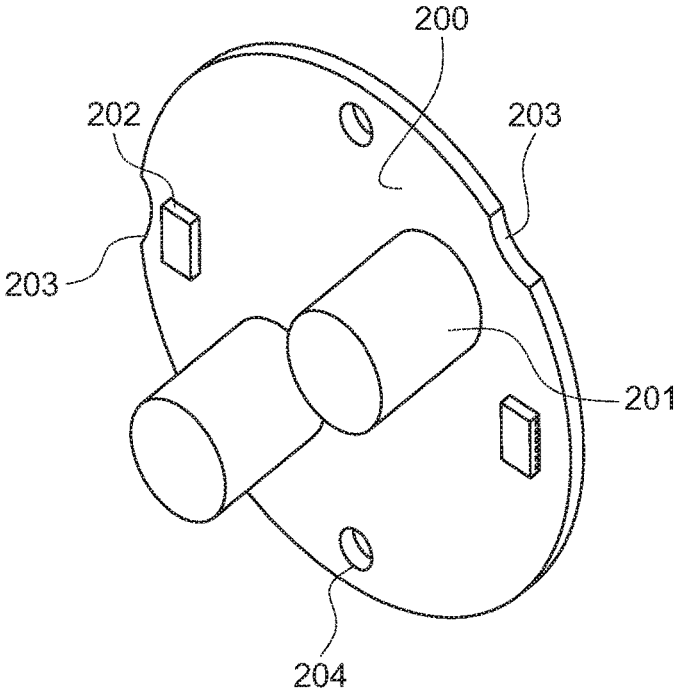
FIG. 2 illustrates an exemplary circuit board of an LED light engine, in accordance with an implementation of the present disclosure.

FIG. 2 illustrates an exemplary circuit board 200 of an LED light engine, in accordance with an implementation of the present disclosure. In this example, the circuit board 200 is connected with the LED board 100 via an array cable (not shown), and comprises capacitors 201 and other supporting electrical components 202. The capacitors 201 can prevent surges and smooth the DC voltage to the LED board 100. In some implementations, the capacitors 201 are also key components in reducing flicker.

In some implementations, the circuit board 200 further comprises holes 204 such that the circuit board 200 can be fixed onto the LED light engine via screws or latches. In some implementations, the circuit board 200 further comprises one or more cut-outs 203. The cutouts 203 are configured to facilitate air circulations around the circuit board 200, and facilitate assembling of the circuit board 200 onto the LED light engine or dissembling the circuit board 200 from the LED light engine.

Figure 3:
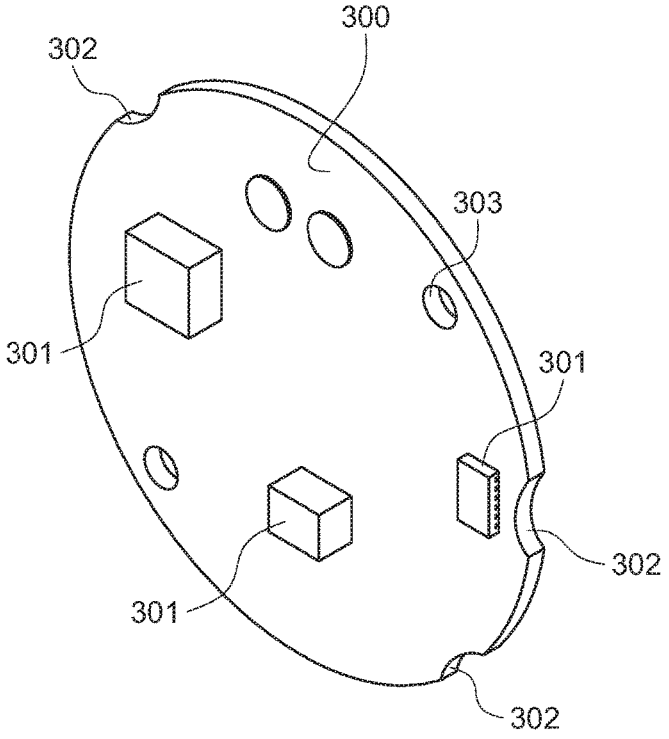
FIG. 3 illustrates an exemplary circuit board of an LED light engine having a linear LED driver integrated circuit (IC), in accordance with an implementation of the present disclosure.

FIG. 3 illustrates an exemplary circuit board 300 of an LED light engine having a linear LED driver integrated circuit (IC) 301, in accordance with an implementation of the present disclosure. In this example, the circuit board 300 is connected to the circuit board 200 via an array cable (not shown) and also connected to an AC line (not shown). The circuit board 300 and the circuit board 200, in combination, are compatible to a triode for alternating current (TRIAC) dimmer, and can ensure minimal variance between cycles in brightness of the LEDs on the LED light emitting board 100. For example, the circuit board 300 and the circuit board 200, in combination, can ensure the LED engine to have a percent flicker less than 30%.

In FIG. 3, the linear LED driver IC 301, combined with the circuit board 200, can drive the LED board 100 directly using an AC line voltage of the AC line. In some implementations, the linear LED driver IC 301 has two or more channels to provide power for two or more string of LEDs. For example, each channel of the linear driver IC 301 can be used to power LEDs in each section of two or more LED sections on the LED board 100.

In this example, the circuit board 300 further comprises holes 303 such that the circuit board 300 can be fixed onto the LED light engine via screws or latches. The circuit board 300 may further comprise one or more cut-outs 302. The cutouts 302 can facilitate air circulations around the circuit board 300, and facilitate assembling of the circuit board 300 onto the LED light engine or dissembling the circuit board 300 from the LED light engine.

Figure 4A:
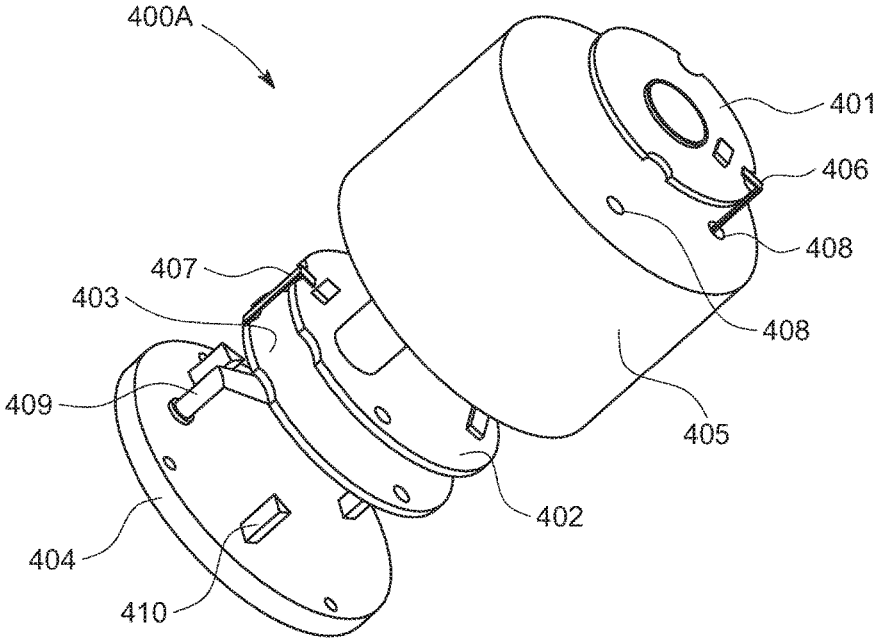
FIGS. 4A-4B illustrate an exemplary LED light engine together with housing, in accordance with an implementation of the present disclosure.

FIG. 4A illustrates an exemplary LED light engine 400A together with a housing 405, in accordance with an implementation of the present disclosure. In this example, the LED light engine 400A comprise an LED board 401, circuit boards 402 and 403, a base 404, and the housing 405. The LED board 401 is connected to the circuit board 402 via an array cable 406. The circuit board 402 is connected to the circuit board 403 via an array cable 407. The circuit board 403 can be fixed onto the base 404 via screws or latches (not shown).

In some implementations, the circuit board 403 is fixed onto supporters 410 of the base 404 via screws or latches. The base 404 may further comprise a cable channel 409 such that an AC line can be connected to the circuit board 403 through the base 404.

In this example, the housing 405 is a heat dissipating housing with a small diameter (e.g., less than 50 mm). The housing can provide mechanical support for the circuit boards 402 and 403 and the LED board 401. The circuit boards 402 and 403 can be fit inside the housing 405. The LED board 401 sits on top of the housing 405. The top of the housing 405 comprises holes 408. The array cable 406 runs through one of the holes 408 to connect the LED board 401 with the circuit boards 402.

Figure 4B:
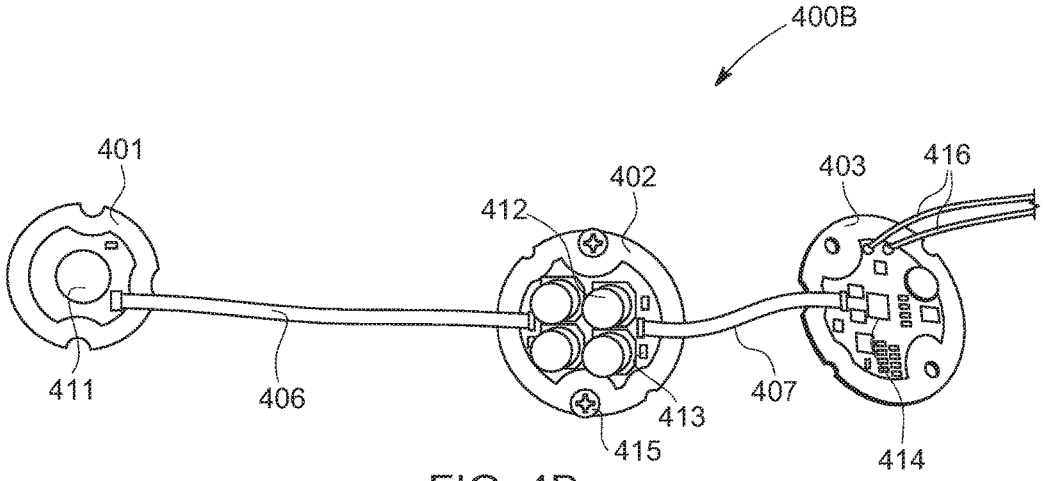

FIG. 4B illustrates a dissembled view 400B of the LED board 401 and the circuit boards 402 and 403 of the LED light engine 400A. As illustrated in FIG. 4B, the LED board 401 includes a light emitting area 411 located in the center. The circuit board 402 comprises capacitors 412 and screws 415 while the circuit board 403 comprises a linear LED driver IC 414. The circuit board 402 is connected to the LED board 401 and the circuit board 403 via array cables 406 and 407, respectively. The circuit board 403 is connected to an AC line 416.

Figure 5A:
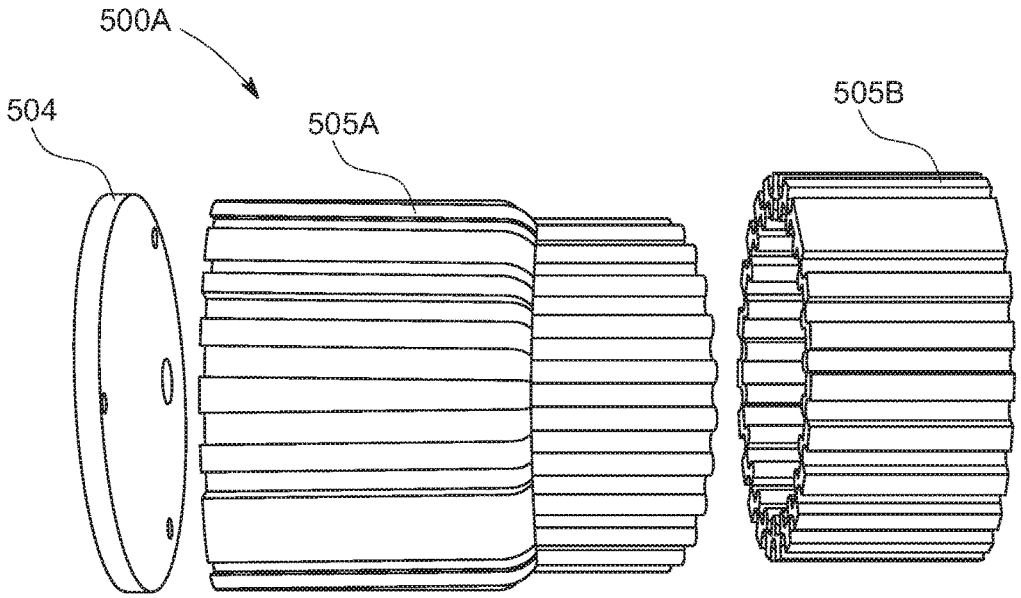
FIG. 5A-5B illustrate another exemplary LED light engine together with housing, in accordance with an implementation of the present disclosure.

FIG. 5A illustrate another exemplary LED light engine 500A together with housings 505A and 505B, in accordance with an implementation of the present disclosure. In this example, the LED light engine 500A further comprise a base 504. The housings 505A and 505B can be fixed onto the based 504. In some implementations, the housings 505A and 505B have a thin metal surfaces, or are made of metal sheets. In some implementations, the base 504 can also be made of thin metal sheets.

The housings 505A and 505B provide mechanical support for components of the LED light engine 500A, and dissipate heat generated by the components of the LED light engine 500A. Further, the housings 505A and 505B, and the base 504 may shield electro-magnetic interference (EMI) generated by the electronic components within the housings 505A and 505B, and help the LED light engine 500A meet various safety and EMI requirements.

Figure 5B:
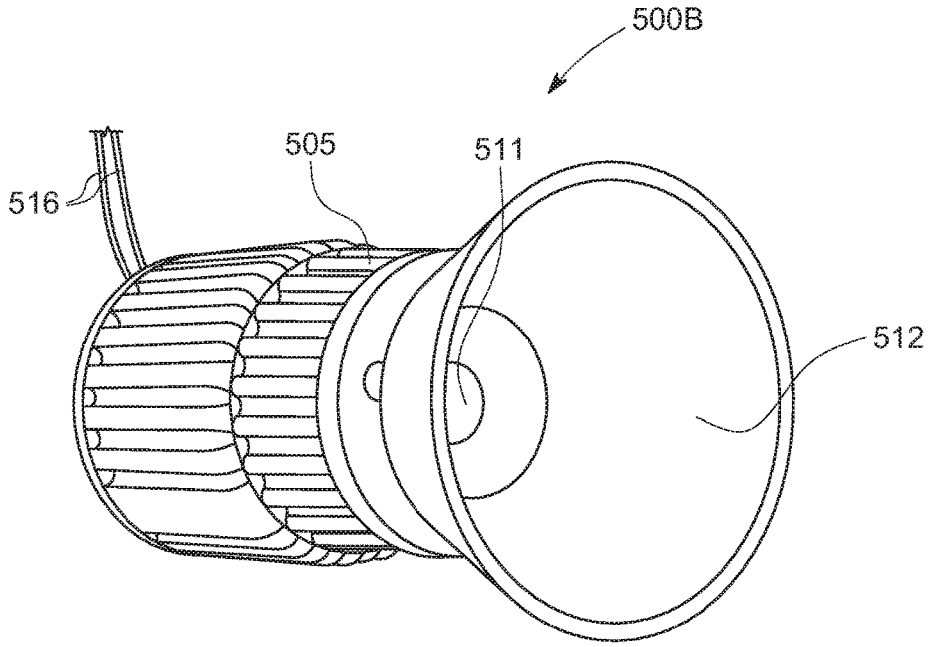

FIG. 5B illustrate another exemplary LED light engine 500B having a housing 505 and an LED light reflector 512, in accordance with an implementation of the present disclosure. In this example, the LED light engine 500B is connected to an AC line 516 via a base (not shown). The LED light reflector 512 surrounds a light emitting area 511, and is configured to guide lights from the light emitting area 511 to an appropriate angle, ensure the lights being shaped appropriately, or help to maintain a specific wavelength of the lights for a specific application. In some examples, the LED light reflector 512 may widely spread the lights from the light emitting area 511. In some implementations, the LED light reflector 512 may disperse heats from the light emitting area 511 to prevent the LED light engine 500B from becoming overheated.

Figure 6A:
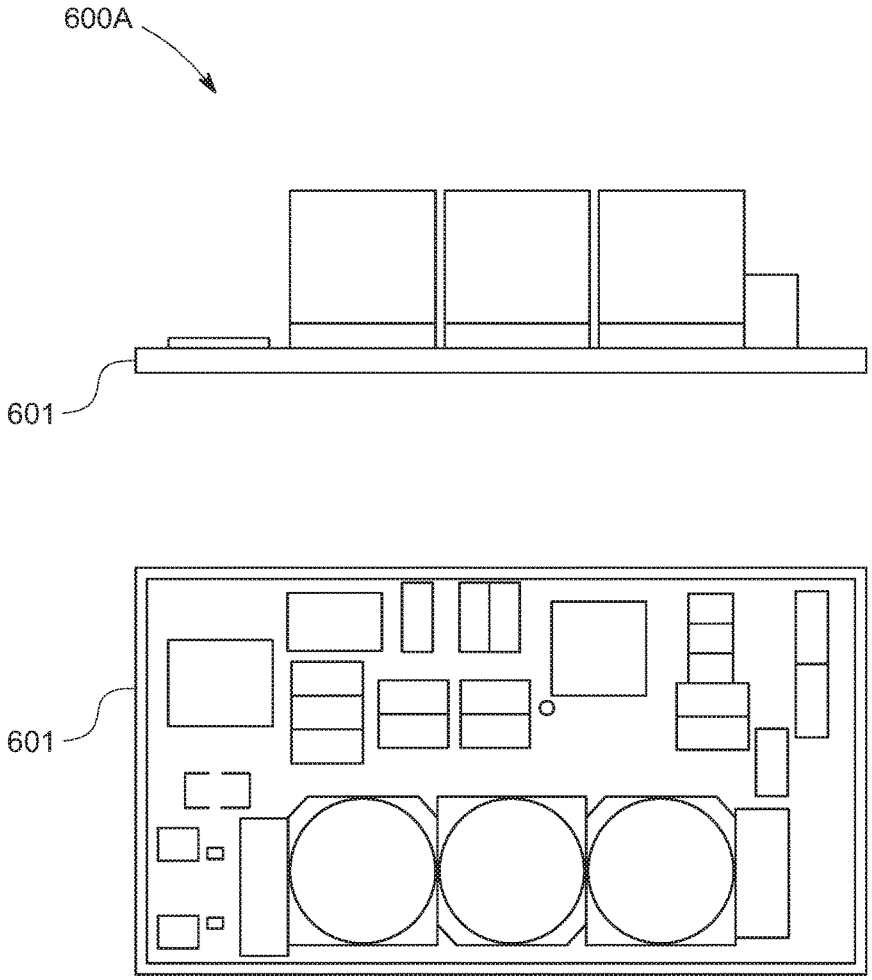
FIG. 6A-6E illustrate another exemplary LED light engine having a combined circuit board, in accordance with implementations of the present disclosure.

FIG. 6A illustrates an exemplary LED light engine 600A having a combined circuit board 601, in accordance with an implementation of the present disclosure. In this example, the combined circuit board 601 has a rectangular shape with a short side and a long side, and has a larger surface area than that of the circular-shaped circuit board illustrated in FIGS. 2, 3, 4A and 4B, respectively.

Figure 6B:
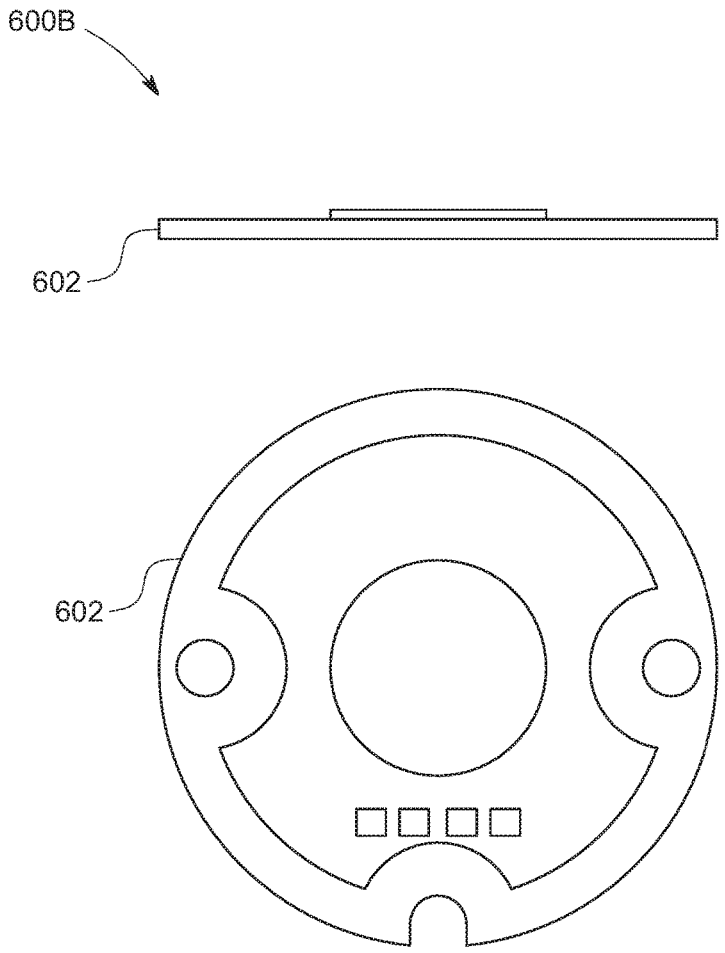

FIG. 6B illustrates an exemplary LED board 602 of an LED light engine 600B having a combined circuit board, in accordance with an implementation of the present disclosure. In this example, the LED board 602 is similar to those LED boards illustrated in FIG. 1, FIG. 4A and FIG. 4B.

Figure 6C:
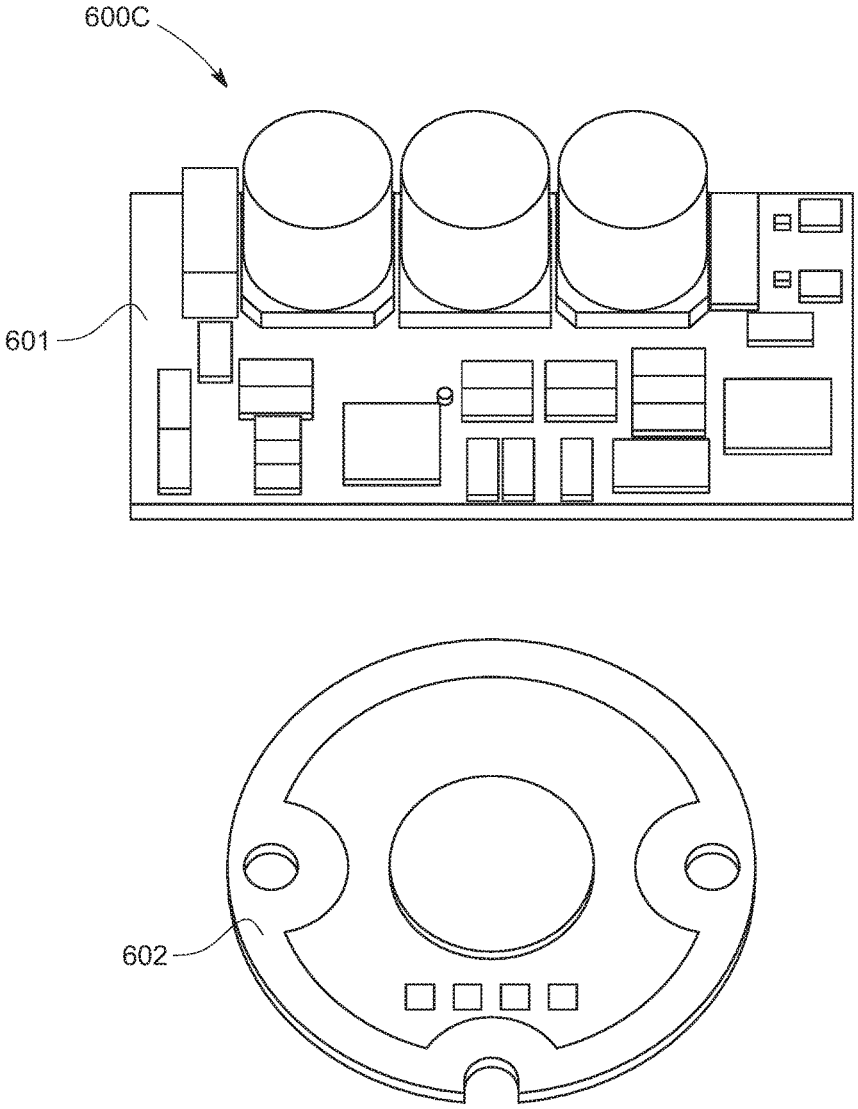

FIG. 6C illustrates an exemplary combined circuit board 601 and an LED board 602 of an LED light engine 600C, in accordance with an implementation of the present disclosure. In this example, the rectangular-shaped circuit board 601 can host all electrical components of the circuit boards illustrated in FIG. 2 and FIG. 3. More particularly, the rectangular-shaped circuit board 601 can host capacitors 201 and other supporting electrical components 202 illustrated in FIG. 2, and the linear LED driver IC 301 illustrated in FIG. 3.

Figure 6D:
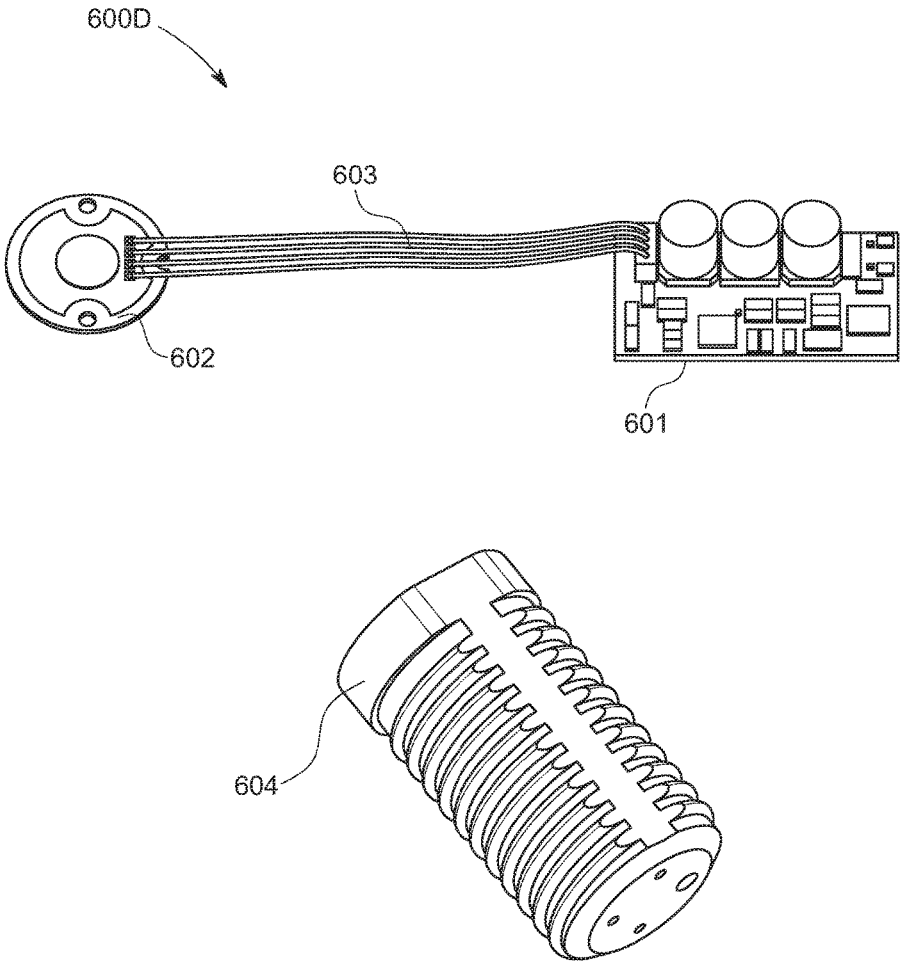

FIG. 6D illustrates an exemplary LED light engine 600D having a combined circuit board 601, an LED board 602, and an array cable 603 connecting the combined circuit board 601 and the LED board 602, in accordance with an implementation of the present disclosure. In this example, the combined circuit board 601, the LED board 602, and the array cable 603 can all be fit into a housing 604 of the LED light engine 600D.

Figure 6E:
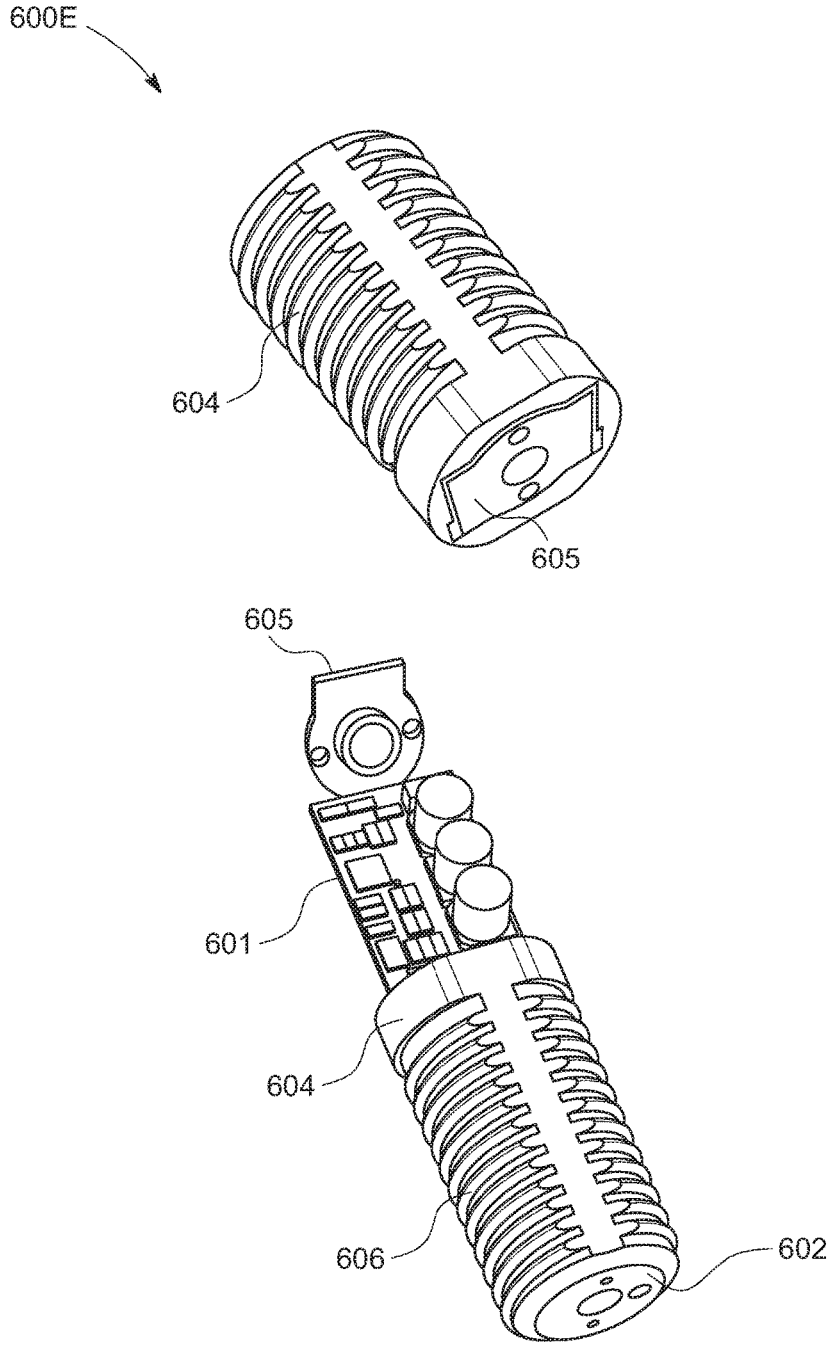

FIG. 6E illustrates an exemplary LED light engine 600E having a combined circuit board 601, an LED board 602, a base 605, and a housing 604, in accordance with an implementation of the present disclosure. In this example, the outer surface of the housing 604 comprises threads 606. The threads 606 are configured to fix or attach the LED light engine 600E to an object (not shown).

In FIG. 6E, the short side of the combined circuit board 601 is less than diameter of inner surface of the housing 604 such that the combined circuit board 601 can fit into the housing 604. The long side of the combined circuit board 601 can be further elongated to accommodate additional electrical components, if necessary.

While various examples of the present disclosure have been described above, it should be understood that they have been presented by way of example only, and not limitation. Numerous changes to the disclosed examples can be made in accordance with the disclosure herein without departing from the spirit or scope of the disclosure. Thus, the breadth and scope of the present disclosure should not be limited by any of the above described examples. Rather, the scope of the disclosure should be defined in accordance with the following claims and their equivalents.

Although the disclosure has been illustrated and described with respect to one or more implementations, equivalent alterations and modifications will occur to others skilled in the art upon the reading and understanding of this specification and the annexed drawings. In addition, while a particular feature of the disclosure may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the disclosure. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this disclosure belongs. Furthermore, terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A light emitting diode (LED) engine, comprising:

an LED light emitting board having a light emitting area located in a center area;

a first circuit board connected to the LED light emitting board via a first array cable; and a second circuit board connected to an AC line, the second circuit being connected to the first circuit board via a second array cable, wherein the second circuit board comprises a linear LED driver integrated circuit (IC), and wherein the linear LED driver IC, in combined with the first circuit board, drives the LED light emitting board directly using an AC line voltage of the AC line.

2. The LED engine of claim 1, wherein LEDs connected to the LED light emitting board are divided into two or more sections, and wherein each of the two or more sections has a different correlated color temperature (CCT) to achieve CCT tuning.

3. The LED engine of claim 1, wherein the LED light emitting board is a Chip-on-Board (COB) LED module with the light emitting area located in the center area.

4. The LED engine of claim 1, wherein the LEDs of the LED light emitting board are flip-chips with wavelength conversion materials encapsulated.

5. The LED engine of claim 4, wherein LEDs of at least one of the two or more sections is a chip-scale-package (CSP) with encapsulated wavelength conversion material.

6. The LED engine of claim 5, wherein there has a layer of wavelength conversion material placed surrounding the encapsulated wavelength conversion material of the CSP.

7. The LED engine of claim 1, wherein the LED light emitting board further comprises one or more cut-outs, and wherein the one or more cut-outs are configured to facilitate air circulations around the LED light emitting board, and/or facilitate assembling of the LED light emitting board onto the LED light engine or dissembling the LED light emitting board from the LED light engine.

8. The LED engine of claim 1, wherein the first circuit board comprises one or more capacitors, the one or more capacitors configured to reduce flicker, prevent surges, and smooth a DC voltage to the LED light emitting board.

9. The LED engine of claim 1, wherein the first circuit board and the second circuit board, in combination, are compatible to a triode for alternating current (TRIAC) dimmer, and ensure a minimal variance between cycles in brightness of LEDs of the LED light emitting board.

10. The LED engine of claim 1, wherein the LED engine has a percent flicker less than 30%.

11. The LED engine of claim 1, wherein the linear LED driver IC has two or more channels to provide power for two or more string of LEDs, wherein LEDs connected to the LED light emitting board are divided into two or more sections, and wherein each channel of the linear driver IC is used to power LEDs in each section of two or more LED sections on the LED light emitting board.

12. The LED engine of claim 1, further comprising a housing, wherein the housing is a heat dissipating housing, and provides mechanical support for the first circuit board, the second circuit board and the LED light emitting board.

13. The LED engine of claim 12, wherein the first circuit board and the second circuit board fit inside the housing, wherein the LED light emitting board sits on top of the housing, wherein the housing has at least one hole, and wherein the first array cable runs through the at least one hole.

14. The LED engine of claim 12, wherein the first and second circuit boards are combined into a single circuit board with a rectangular shape to fit into the housing.

15. The LED engine of claim 12, wherein the housing has a diameter less than 50 mm.

16. The LED engine of claim 1, further comprising an LED light reflector, wherein the LED light reflector is configured to guide lights from the light emitting area, or maintain a specific wavelength of the lights for a specific application.

* * * * *